US007201252B2

(12) United States Patent
Nevill

(10) Patent No.: US 7,201,252 B2
(45) Date of Patent: Apr. 10, 2007

(54) LOUDSPEAKER SYSTEMS

(75) Inventor: Stuart Michael Nevill, Kent (GB)

(73) Assignee: B & W Loudspeakers Limited, Sussex (GB)

( * ) Notice: Subject to any disclaimer, the term of this patent is extended or adjusted under 35 U.S.C. 154(b) by 228 days.

(21) Appl. No.: 10/490,359

(22) PCT Filed: Sep. 12, 2002

(86) PCT No.: PCT/GB02/04145

§ 371 (c)(1),
(2), (4) Date: Mar. 27, 2004

(87) PCT Pub. No.: WO03/026347

PCT Pub. Date: Mar. 27, 2003

(65) Prior Publication Data

US 2004/0245042 A1 Dec. 9, 2004

(30) Foreign Application Priority Data

Sep. 21, 2001 (GB) ..... 0122861.8

(51) Int. Cl.
*H04R 1/28* (2006.01)
*H04R 1/02* (2006.01)
*H04R 1/38* (2006.01)

(52) U.S. Cl. ..... 181/151; 181/156; 181/155; 381/345; 381/349

(58) Field of Classification Search ..... 181/156, 181/155, 151; 381/345, 349
See application file for complete search history.

(56) References Cited

U.S. PATENT DOCUMENTS 2,295,483 A * 9/1942 Knowles ..... 381/404
2,646,852 A 7/1953 Forrester
3,687,221 A * 8/1972 Bonnard ..... 181/180

(Continued)

FOREIGN PATENT DOCUMENTS

FR 2 245 143 9/1973

(Continued)

*Primary Examiner*—Lincoln Donovan
*Assistant Examiner*—Jeremy Luks
(74) *Attorney, Agent, or Firm*—Buchanan Ingersoll & Rooney PC

(57) ABSTRACT

A loudspeaker system includes a loudspeaker drive unit (1) and a rear sound absorption system (20) having a multiplicity of tubes connected to the rear of the loudspeaker drive unit. In one example, the rear sound absorption system (20) comprises a collector tube (22) for sound waves emerging from a passage in the magnet assembly of the loudspeaker drive unit, an annular diffuser (24) for sound waves coming from the back of the diaphragm (4), and a disk-shaped diffuser (26) for second waves collected by the collector tube (22). The disk-shaped diffuser (26) is part of a basket-like assembly (28) mounted on the rear of the magnet assembly (6). The annular diffuser (24) is mounted against the wall (2) of the enclosure in which the loudspeaker drive unit (1) is mounted. The annular diffuser (24) includes a base portion (24A) with integral upstanding vanes (24B) arranged in a spiral configuration. A multiplicity of channels (24C) are defined between the vanes (24A), and the wall (2) of the enclosure closes off the open faces of the channels (24C) so that they form a multiplicity of tapering tubes.

24 Claims, 6 Drawing Sheets

U.S. PATENT DOCUMENTS

| | | | | | |
|---|---|---|---|---|---|
| 3,917,024 | A | * | 11/1975 | Kaiser, Jr. | 181/163 |
| 4,168,761 | A | * | 9/1979 | Pappanikolaou | 181/156 |
| 4,690,244 | A | * | 9/1987 | Dickie | 181/146 |
| 5,206,465 | A | | 4/1993 | Kon | |
| 5,721,786 | A | * | 2/1998 | Carrington | 381/423 |
| 5,909,015 | A | * | 6/1999 | Yamamoto et al. | 181/156 |
| 6,062,339 | A | * | 5/2000 | Hathaway | 181/156 |
| 6,278,789 | B1 | * | 8/2001 | Potter | 381/338 |

FOREIGN PATENT DOCUMENTS

| | | | |
|---|---|---|---|
| FR | 2 676 322 | | 11/1992 |
| GB | 626623 | | 9/1946 |
| GB | 2 290 672 | A | 1/1996 |
| GB | 2 365 250 | A | 2/2002 |
| JP | 2000-041292 | | 2/2000 |
| WO | WO98/51121 | | 11/1998 |

* cited by examiner

LOUDSPEAKER SYSTEMS

BACKGROUND OF THE INVENTION

This invention relates to loudspeakers systems.

In a conventional speaker system the mounting is usually a cabinet at the rear of the loudspeaker drive unit into which sound passes. The main function of the rear cabinet is to prevent the rearward radiation coming round to the front and then, since it is out of phase, cancelling out the frontward radiation.

The rear box can be totally enclosed, in which case all the direct rearward sound is prevented from coming round to the front. Or the box may have a hole in it, in which case the mass of air in the hole and the stiffness of the air in the box produce a "Helmholtz" resonance which may be used to reinforce the bass response of the speaker.

Other ways of preventing the rear-front cancellation are (a) to place the speaker on a large baffle and (b) to pass the sound down a tube of sufficient length so that when it emerges from the end, at the later time which depends on the length, it is in phase with the low frequency part of the front radiation which it then reinforces rather than cancels.

Furthermore, the use of tubes as damped quarter-wave (or longer) transmission lines for absorbing the unwanted acoustic output from the rear of loudspeaker is now well established. It is also known that tapering the cross-sectional area of such a device in the manner of an inverse horn significantly improves the absorption efficiency. The tapering tube is acoustically coupled to the rear of a loudspeaker drive unit to lead away and absorb sound waves produced at the rear of the loudspeaker drive unit.

GB-A-2 290 672 discloses a loudspeaker system comprising a bass unit, a mid-range unit, a treble unit, and a tweeter unit. Each of the units includes a respective loudspeaker drive unit. The mounting for the loudspeaker drive unit is such that there is substantially no rear reflecting surface behind the diaphragm of the loudspeaker drive unit. The pole piece of the respective magnet system of each loudspeaker drive unit is provided with an aperture through which, in use, sound from the rearward side of the diaphragm passes. Each of the loudspeaker drive units has a respective circular-section tube extending from the rear of the loudspeaker drive unit. Each tube contains sound-absorbent material such as glass fibre and tapers away from the associated loudspeaker drive unit.

Patent specification WO 98/51121 discloses a loudspeaker system which comprises: a loudspeaker drive unit and a tube acoustically coupled to the rear of the loudspeaker drive unit for leading away and absorbing sound waves produced at the rear of the loudspeaker drive unit. The tube is acoustically coupled to the loudspeaker drive unit by means of a hollow resonant enclosure and the loudspeaker drive unit is mounted at an aperture in an external wall of the enclosure. The tube communicates with the interior of the enclosure and extends outwardly from the enclosure.

A disadvantage of the known systems having a tube at the rear of a loudspeaker drive unit is that they are, at least in the case of bass and mid-range units, cumbersome and are not therefore very satisfactory for home use where space is often at a premium.

In recent years, so-called flat panel loudspeaker systems (the term "loudspeaker system" being used to mean the combination of at least one loudspeaker drive unit and a loudspeaker enclosure) have been introduced of which the overall depth is much reduced in comparison with a loudspeaker system of traditional design. The reduced depth is possible because mid-range and bass loudspeaker drive units with a reduced front to back dimension have been developed.

The known systems having a tube at the rear of a loudspeaker drive unit are virtually unusable in a flat panel loudspeaker system on the ground of spatial restrictions.

OBJECT AND SUMMARY

It is an object of the invention to provide a loudspeaker system with sound absorption by a rear tube yet which can be made less cumbersome than known loudspeaker systems.

The present invention provides a loudspeaker system comprising a loudspeaker drive unit, said drive unit including a sound-producing diaphragm having front and rear faces, and a rear sound absorption system located on the rear of said loudspeaker drive unit on a sound path running rearwardly from the rear face of said diaphragm to the said rear sound absorption system, the rear sound absorption unit comprising a multiplicity of tubes, operative to create acoustic loss, running in a spiral configuration.

Replacement of the single tube of the prior art by a multiplicity of tubes according to the invention results in tubes of acoustically smaller internal dimensions for a given total cross-section. A tube of acoustically small internal dimensions can be bent to a tighter radius than a larger tube without unduly hindering the passage of wavelengths smaller than the radius of curvature. Thus, a single tube of the prior art can be replaced by a multiplicity of tubes with a common entrance that can be readily shaped to fill an available space.

Not only does the replacement of a single tube by a multiplicity of smaller tubes not significantly alter either the bulk acoustic parameters or the length-wise standing wave resonances but there is also an advantageous increase in viscous losses owing to the smaller cross-sectional area of the individual tubes as compared with a single tube. Furthermore, an almost complete eradication of problematic tube cavity transverse resonance modes across the width of the tube at elevated frequencies can be achieved. Generally speaking, transverse modes occur when whole numbers of half a wavelength of the current sound frequency correspond to a transverse dimension of the tube. Longitudinal modes, which need to be absorbed by either sound-absorbent material in the tubes or by the viscous losses in the air, occur when a whole number of half wavelengths of the current sound frequency corresponds to the length of the tube (taking into account, however, end conditions and any taper). Since the cross-sectional dimensions of most tubes are much smaller than their lengths, transverse modes will occur at much higher frequencies than longitudinal modes.

Preferably, for making a mid-range loudspeaker system, each tube has a length between 50 and 200 millimeters inclusive, more preferably between 50 and 150 millimeters inclusive, yet more preferably between 50 and 100 millimeters inclusive, and more preferably still between 60 and 80 millimeters inclusive. For a bass loudspeaker drive unit, the lengths are preferably made between 5 and 10 times as long. For a high frequency (tweeter) loudspeaker drive unit, the lengths are preferably reduced to between one tenth and one fifth.

Preferably, the number of tubes is between 4 and 20 inclusive, more preferably between 5 and 15 inclusive, and yet more preferably between 6 and 12 inclusive. These numbers are applicable to bass, mid-range and high frequency loudspeaker drive units but are especially applicable to mid-range loudspeaker drive units.

Advantageously, each tube has a cross-sectional area less than 250 square millimeters, preferably less than 200 square millimeters, more preferably less than 150 square millimeters, and yet more preferably less than 100 square millimeters.

The tubes may be at any angle to the axis of the speaker driver.

Advantageously, the tubes are arranged transversely to the axis of the loudspeaker driver unit and preferably at right angles to the axis of the loudspeaker drive unit.

Advantageously, the tubes run in a spiral configuration.

Extending the tubes transversely to the axis of the loudspeaker drive unit enables a space-saving construction to be achieved. For maximum space efficiency, economy of material usage and improved acoustic performance the tubes are, however, advantageously arranged as a series of approximately concentric spirals. A diffuser taking the form of a base portion with spiral channels separated by vanes may be used to define the tubes, the diffuser having a face mating, for example, with the rear face of the magnet assembly of the loudspeaker drive unit.

The use of a spiral diffuser is, however, not limited to applications in which the diffuser has a face mating with a face of the magnet assembly, it may remain separate therefrom and be fed by a connecting tube to its centre. A centrally mounted diaphragm may also be arranged to pass sound radially into an annular spiral diffuser.

The entrance to a diffuser may, if desired, be at its outer perimeter. Typically, a diffuser would employ logarithmic type spirals of a power >1 with the base portion of the diffuser being concave looking towards its mating face. The diffuser may have a form resembling a turbine impeller or alternatively it may have Fermat type spirals.

Advantageously, the tubes taper away from the rear of the loudspeaker drive unit, preferably with an exponentially decreasing taper.

The tubes may, however, taper to smaller dimensions with any known inverse horn profile.

Advantageously, the diffuser has a base portion which is concave relative to the rear face of the magnet assembly of the loudspeaker drive unit and the vanes follow a path defined by a Fermat spiral of a power <1. In this way, the path length and taper rate of an optimally tapered single tube transmission line can be matched. The spiral path length is not limited by the radius of the rear face of the magnet assembly, the grooves may continue up the inner wall of a cup-shaped diffuser that encases the rear of the magnet assembly. Advantageously, the grooves continue to rotate so as to form a screw-type pattern on the inside of the diffuser cup walls.

Preferably, the multiplicity of tubes contain sound-absorbing material

Advantageously, the tubes are defined by first and second juxtaposed components and preferably by a multiplicity of channels located on the first component, the open faces of the channels being closed by a face of the second component to define the tubes.

The open faces of the channels may terminate in a plane and be closed by a flat face of the second component.

Instead, the open faces of the channels may terminate in a curved surface and be closed by a complementary curved face of the second component.

The channels may be defined by upstanding walls on the first component.

The depth of each channel may be between 3 and 10 millimeters inclusive, preferably between 4 and 7 millimeters inclusive.

The first component may be annular.

The first component may be part conical.

The first component may be a disk.

A known high fidelity, high frequency loudspeaker drive unit (or tweeter) comprises a radiating dome diaphragm, voice coil, a surround, a ring-shaped magnet assembly, and a tapered tube behind the magnet assembly. The dome radiation passes rearwardly through the centre of the ring-shaped magnet assembly and down the tube where it is absorbed by sound-absorbing wadding. The consistent placement of the wadding in the tube is difficult to achieve in commercial manufacture.

Mid range units typically comprise a cone-shaped diaphragm which may or may not have a dome shaped dust dome fixed over the voice coil and attached axi-symmetrically to the cone. The cone usually communicates to an air tight volume at its rear, and the rear of the dust dome may communicate to either the same cavity via a hole through the centre of the pole piece or the dust dome may communicate to an entirely separate volume instead.

Known bass units are constructed in a similar manner to mid range units with all elements being correspondingly larger.

In all cases, the consistent placing in commercial manufacture of sound-absorbing wadding in a rear-loading tube is tedious or problematic. Filling small individual tubes with wadding is even more laborious than filling a single large one.

Advantageously, according to the invention, a layer of absorbing material is sandwiched between the first and second components.

The difficulty of filling a tube with sound-absorbing material can be overcome by this means with the achievement of similar acoustic performance to a conventional transmission line but with improved distribution and ease of filling. A pad of sound-absorbing material can be used both for filling the tubes and for providing a gasket sealing the surfaces of two mating parts. The degree of compression of the gasket can be adjusted according to whether a well-sealed or leaky interface between adjacent tubes is desired.

Advantageously, the cross-sectional area of the tubes is sufficiently small for the viscosity of the air within to provide substantial sound absorption.

Advantageously, the rear sound absorption system includes a common connecting tube which connects the rear of the loudspeaker drive unit to the multiplicity of tubes.

Preferably, the connecting tube runs substantially co-axially with the axis of the loudspeaker drive unit.

The tubes of the said multiplicity may be connected to different points along the length of the connecting tube.

Advantageously, the tubes are so arranged that high pressure points of the standing waves in one tube are adjacent to low pressure points in an adjacent tube and communication is provided between adjacent tubes along their lengths.

In a spiral configuration of the tubes, neighbouring spirals are advantageously arranged so that neighbouring high pressure points of the standing waves in one tube are adjacent to low pressure points in the next tube, there being communication from one tube to the other along their lengths at such selected points so as to cancel out the standing wave resonances present in each tube.

Advantageously, communication is provided at a multiplicity of points along the entire length of the tubes. When the tubes are allowed to communicate along their entire lengths, standing wave resonances in each tube can be cancelled out.

Preferably, the tubes are closed at their ends.

Instead, the tubes may be open at their ends.

The system may include an enclosure comprising:

a first, rigid panel, a second, rigid panel aligned in spaced, substantially parallel, relationship with the first panel, a multiplicity of partition walls running transverse to the planes of the panels and dividing the interior space of the enclosure into a single layer of cells bounded at one face by the inside of the first panel and bounded at the opposite face by the inside of the second panel, the partition walls being bonded at the one face to the inside of the first panel and at the opposite face to the inside of the second panel, and a multiplicity of apertures in the partition walls providing communication between adjacent cells of the single layer of cells.

The cells may each have a cross-sectional area parallel to the panels in the range 0.25 to 10 $cm^2$, the apertures may each have a cross-sectional area of at least 0.04 $cm^2$, and at least 55% of the wall between a cell and an adjoining cell may be imperforate.

BRIEF DESCRIPTION OF THE DRAWINGS

Ways of carrying out the invention will now be described, by way of example only, with reference to the accompanying drawings, in which.

DETAILED DESCRIPTION OF THE PREFERRED EMBODIMENTS

Figure 1:
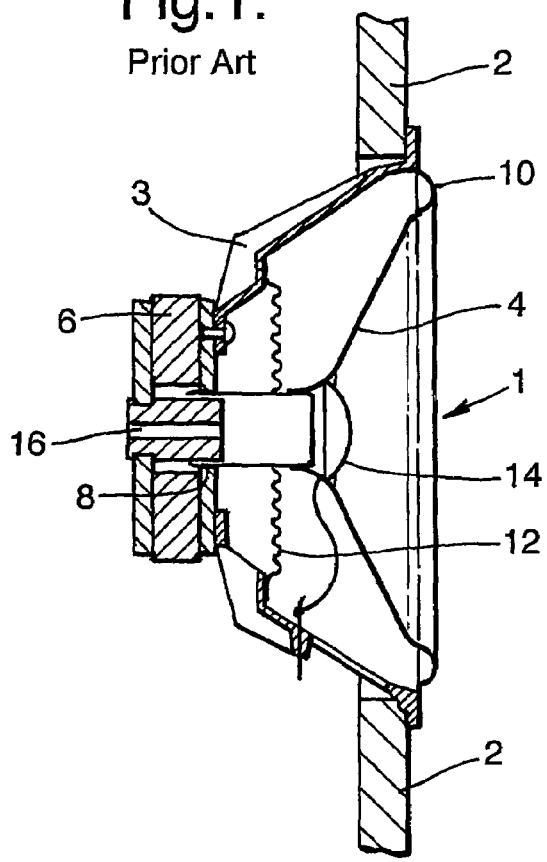
Fig.1. Prior Art
FIG. 1 is a diagrammatic cross-section through a mid-range hi fi loudspeaker drive unit of the prior art mounted in the wall of the enclosure.

Referring to the accompany drawings, FIG. 1 shows a mid-range hi fi loudspeaker drive unit 1 of the prior art mounted in an aperture in a wall 2 of an enclosure. The drive unit 1 has an apertured chassis 3, a conical diaphragm 4, a magnet assembly 6, a voice coil 8, a surround 10, and a suspension 12. A dust dome 14 is provided in the centre of the diaphragm 4 and an axial passage 16 passes through the magnet assembly 6.

When the loudspeaker drive unit is in operation, sound waves are able to pass rearwardly from the diaphragm 4 through the apertured chassis 3, and from the dust dome 14 through the passage 16.

Figure 2:
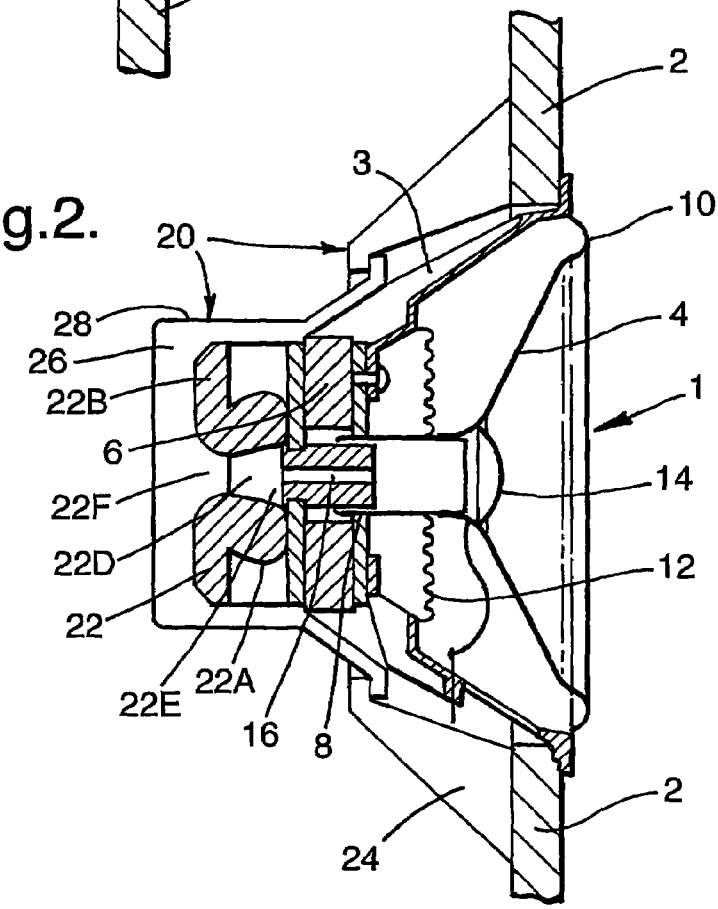
FIG. 2 is a diagrammatic viewing showing the loudspeaker drive unit of FIG. 1 provided with a rear sound absorption system in accordance with the invention.

FIG. 2 shows a rear sound absorption system 20 applied, in accordance with the invention, to absorb the rearward sound waves. The rear sound absorption system 20 comprises a metal collector tube 22 for sound waves emerging from the passage 16, an annular diffuser 24 of plastics material for sound waves coming from the back of the diaphragm 4, and a disk-shaped diffuser 26 of die-cast metal for sound waves collected by the collector tube 22. The disk-shaped diffuser 26 is part of a basket-like assembly 28 which is mounted on the rear of the magnet assembly 6, by screws (not shown) for example, and also serves to mount the annular diffuser 24. The annular diffuser 24 is mounted against the wall 2 of the enclosure in which the loudspeaker drive unit 1 is mounted, for example, by securing it thereto by means of adhesive.

The annular diffuser 24 comprises a base portion 24A with ten integral upstanding vanes 24B arranged in a spiral configuration. The vanes 24B have their greatest height nearer the centre of the diffuser 24 and become shallower as they progress towards the outside of the diffuser. The distal edges of the vanes 24B lie in a common plane by virtue of the fact that the base portion 24A is not flat but concavely shaped (seen from the vane side) to correspond to the tapering away of the vanes. A multiplicity of channels 24C are thus defined between the vanes 24A, the channels diminishing in both width and height as they spiral away from the centre to the outside of the diffuser 24. The wall 2 of the enclosure closes off the open faces of the channels 24C so that they form a multiplicity of tapering tubes. The ends of the tubes are closed by the rim 24D of the diffuser 24. Preferably, sound-absorbent material is provided in the tubes by means of an annular disk of sound-absorbent material (not shown) sandwiched between the diffuser 24 and the wall 2.

The collector tube 22 comprises an entrance portion 22A leading to a flange portion 22B. The entrance portion has a convex annular face 22C surrounding a central bore 22D. The central bore 22D has a tapered portion 22E followed by a flared portion 22F opening in the centre of the flange portion 22B. The flared portion 22F preferably follows a parabolic curve.

The disk-shaped diffuser 26 is of generally similar construction to the diffuser 24 in that it comprises a base portion 26A with six integral upstanding vanes 26B arranged in a spiral configuration. The vanes 26B have their greatest height at the centre of the diffuser 26 and become shallower as they progress towards the outside of the diffuser. The distal edges of the vanes 26B lie on a curved surface since the base portion 26A is flat. A multiplicity of channels 26C are thus defined between the vanes 26A, the channels diminishing in both width and height as they spiral away from the centre to the outside of the diffuser 26. The vanes 26B meet at the centre of a projecting central portion 26D. The connecting tube 22 closes off the open faces of the channels 26C so that they form a multiplicity of tapering tubes. The tubes are closed off at their outer ends by the peripheral portion of the base portion 26A. Preferably, sound-absorbent material is provided in the tubes by means of a disk of sound-absorbent material (not shown) sandwiched between the diffuser 26 and the connecting tube 22.

The diffuser 26 mates with the flared portion 22F of the collector tube 22 and extends some way into the central bore 22D. Thus, in the central bore 22D, preferably before the exit curve begins, the diffuser 26 has vanes 26B which diametrically divide the hole into a multiplicity of smaller, separate channels. The central portion 26D of the diffuser 26 defines a parabolic cone with a radius of curvature that is approximately concentric with the central bore 22D. The vanes 26B continue down along the surface of the conical section, their outer edges closely following the profile of the bore. Thus, a multiplicity of non-cylindrical tubes are formed that are bounded by the vanes as walls, the central portion as floors and the inside of the collector tube as ceilings. The tubes run radially from the centre of the bore. The geometry of these walls, floors and ceilings is such as to ensure that the total cross-sectional area of the tubes, perpendicular to their respective central axes is as defined by the respective positions along a notional inverse horn serving as a design model. Alternatively a notional straight tube can form the design model.

The vanes provide the separation into individual tubes, and the path length from the central point to a point at a given radius on a vane will vary according to the initial angle between adjacent vanes.

The multiplicity of individual tubes can be so dimensioned that when summed together they are equivalent, in cross-section at any given point along their length, to any known single tube for rearward sound absorption from a given loudspeaker drive unit.

It is advantageous to provide communication between the spirals in order to weaken the fundamental pipe resonances. This communication between the spirals can take the form of a series of holes along the lengths of the vanes and the holes may be sufficiently small and numerous as to be considered as a kind of porosity of the vanes. For example, the holes can each have a cross-sectional area of at least 0.04 $cm^2$, and at least 55% of the vane between adjacent tubes can be imperforate It is especially advantageous to arrange for a resonant node in one tube to be made adjacent to an anti-node in an adjacent tube so that, in effect, there will be cancellation of the standing waves in the two adjacent tubes.

Figure 4:
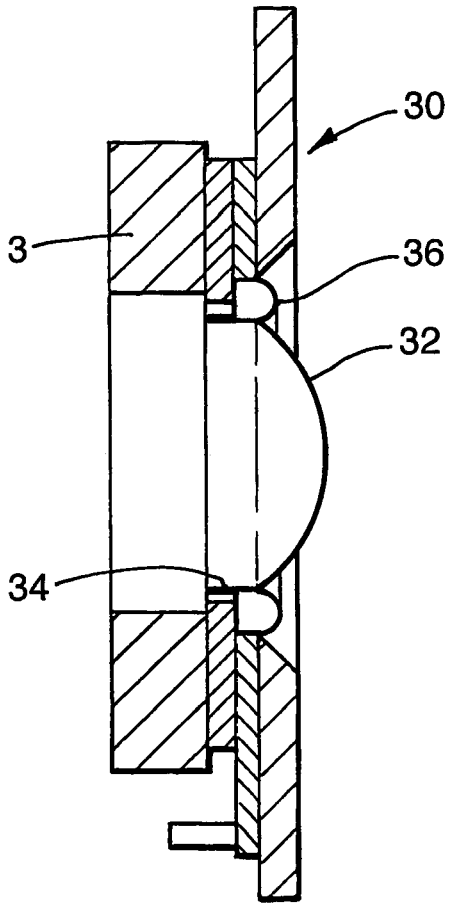
Fig.4. Prior Art
FIG. 4 is a diagrammatic cross-section through a high frequency hi fi loudspeaker drive unit of the prior art.

FIG. 4 shows a known high fidelity, high frequency loudspeaker drive unit (or tweeter) 30 comprising a radiating dome diaphragm 32, voice coil 34, surround 36, and a ring shaped magnet assembly 38.

Figure 5:
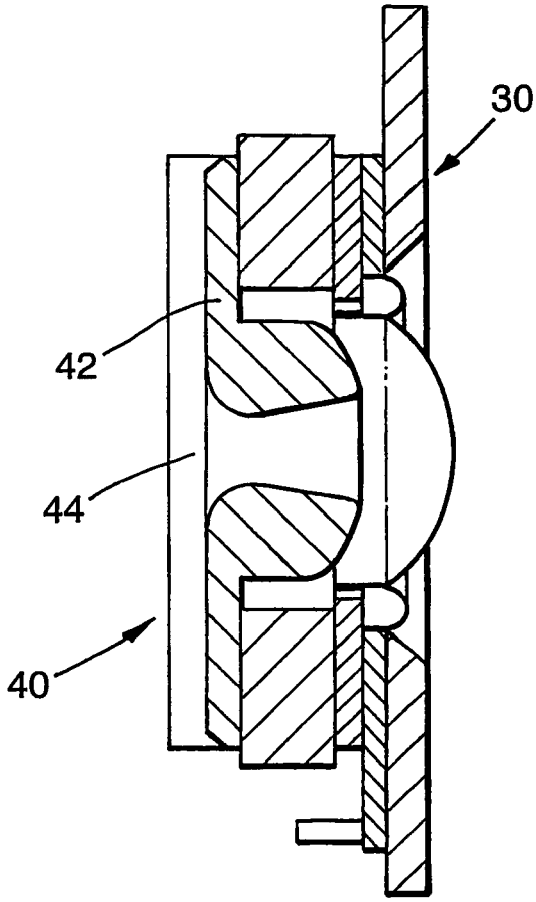
FIG. 5 is a diagrammatic viewing showing the loudspeaker drive unit of FIG. 4 provided with a rear sound absorption system in accordance with the invention.
Figure 6:
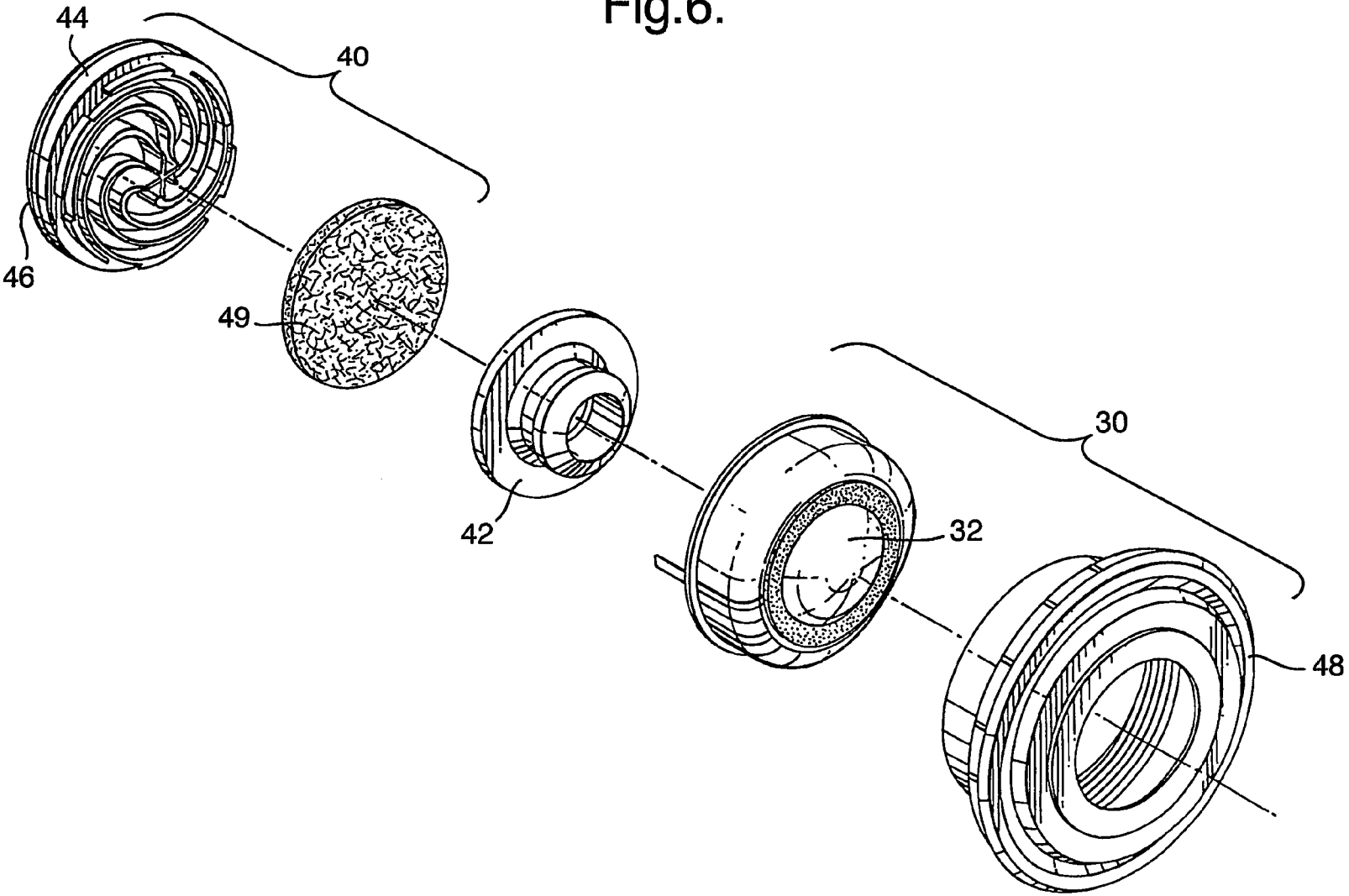
FIG. 6 is an exploded perspective view of the rear sound absorption of FIG. 5.

FIGS. 5 and 6 show a rear sound absorption system 40 applied, in accordance with the invention, to absorb the rearward sound waves from the loudspeaker drive unit 30. The rear sound absorption system 40 comprises a collector tube 42 for sound waves emerging from the back of the dome diaphragm 32, and a disk-shaped diffuser 44 for sound waves collected by the collector tube 42. The disk-shaped diffuser 44 has an externally-threaded threaded portion 46 which screws into an internally-threaded housing portion 48.

Figure 3:
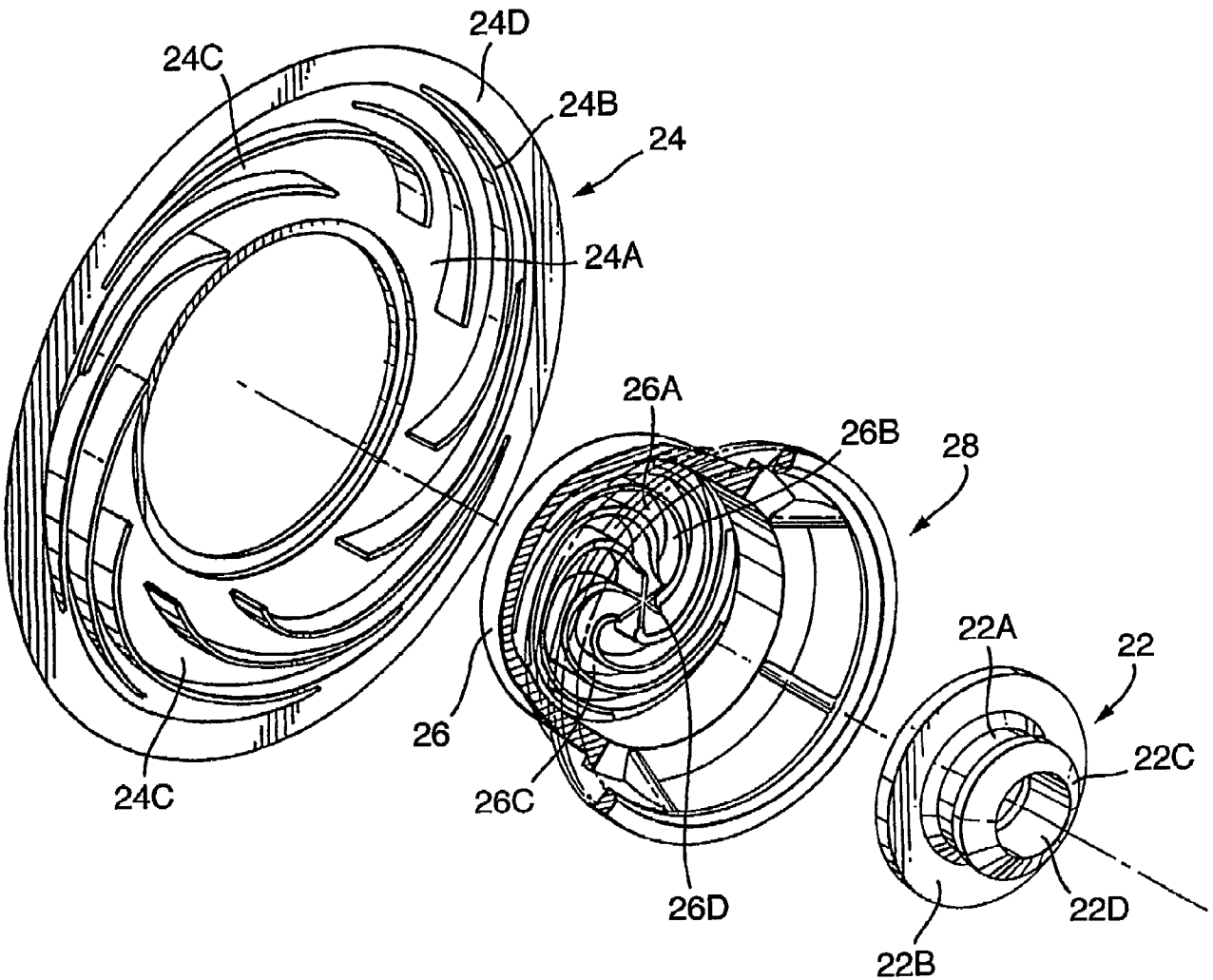
FIG. 3 is an exploded perspective view of the rear sound absorption system of FIG. 2.

The connector tube 22 of FIG. 3 and the connector tube 42 of FIGS. 5 and 6 are, in the examples shown, identical. Thus, there is no need to describe the connector tube 42 further.

The disk-shaped diffuser 46 is made of plastics material and corresponds to the base portion 26A and vanes 26B of the diffuser 26 and thus does not need to be described in further detail.

A disk of acoustic wadding 49 is sandwiched between the collector tube 42 and the diffuse 44. Acoustic absorption may be provided simply by sandwiching a disc of loose wadding between the diffuser and the flat (or grooved) rear face of the magnet. The wadding serves as a mating gasket whilst partially filling the grooved channels of the diffuser. Alternatively, using a much larger number of much narrower grooves to greatly increase viscous losses with the resulting tube surfaces can enable the omission of any separate damping materials, the diffuser vanes can then simply be bonded to the face of the magnet assembly. Thus, the tubes are made sufficiently narrow, viscous losses in the air alone can provide the necessary acoustic loss mechanism.

The arrangement of multiple tubes allows a simple manufacturing method, efficiently utilizes available space especially where depth is restricted, allows easy and consistent application of wadding or other forms of damping yet provides similar acoustic performance to a conventional tapered tube system.

In many cases, the back face of the magnet assembly of a loudspeaker drive unit will be flat and perpendicular to the bore. This is not, however, essential to the application of the invention. Virtually any particular cross sectional shape can be matched by a complementary shape.

The grooves and diffuser can themselves be formed on the face of the magnet assembly with a profiled plate or cup enclosing the channels. In another arrangement, the channels may be made by a combination of grooves on two mating surfaces.

The invention is of particular value for use in a flat panel type loudspeaker system, in particular, a construction such as is described in patent specification No. PCT/GB01/03249. Such a construction will now be described.

Figure 7:
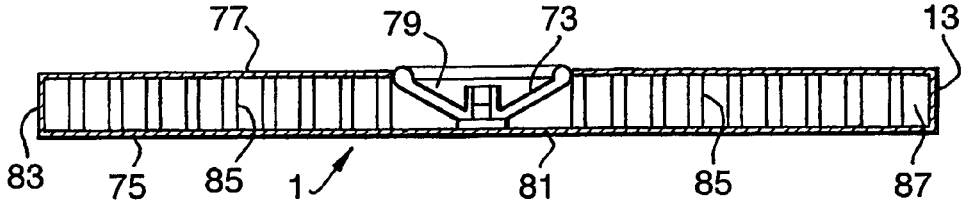
FIG. 7 is a diagrammatic cross-section through a flat panel loudspeaker system.

Referring to FIG. 7, a loudspeaker system 71 comprises a loudspeaker drive unit 73 of the modern reduced physical depth type, embodying the invention and mounted in an enclosure 75. The loudspeaker drive unit 73 can be either a tweeter or mid-range unit. The enclosure 75 comprises a first, flat, metal panel 77 forming the front of the enclosure and having an opening 79 therein in which the loudspeaker drive unit 73 is mounted. The enclosure 75 further comprises a second, flat, metal panel 81 aligned in spaced, substantially parallel, relationship with the first metal panel 7 and forming the rear of the enclosure.

The cells each have a cross-sectional area parallel to the panels in the range 0.25 to 10 $cm^2$, the apertures each have a cross-sectional area of at least 0.04 $cm^2$, and at least 55% of the wall between a cell and an adjoining cell is imperforate.

A peripheral wall 83 runs about the periphery of the first and second metal panels 77, 81 to enclose the space therebetween, the peripheral wall running transverse to the planes of the metal panels and being bonded at the front to the first metal panel and at the rear to the second metal panel. Epoxy resin is a suitable adhesive for securing the peripheral wall 83 in place.

A multiplicity of metal partition walls 85 run transverse to the planes of the metal panels 77, 81 and divide the interior space of the enclosure into a single layer of cells 87 bounded at the front by the inside of the first metal panel 77 and bounded at the rear by the inside of the second metal panel 81, the partition walls being bonded at the front to the inside of the first metal panel and at the rear to the inside of the second metal panel.

A multiplicity of apertures 89 (not shown in FIG. 7) in the metal partition walls 85 provide communication between adjacent cells of the single layer of cells 87.

Figure 8:
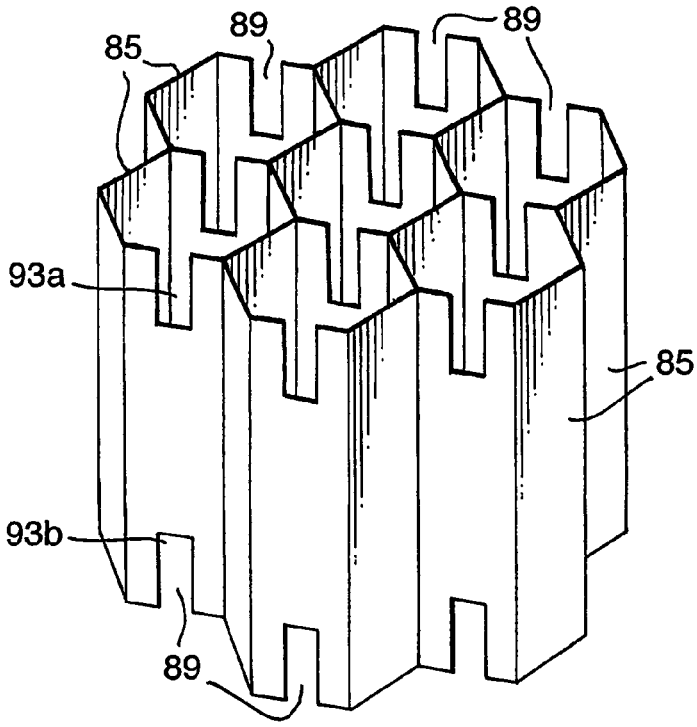
FIG. 8 shows a network of cells used in the enclosure of the loudspeaker system of FIG. 7.

The partition walls 85 are formed by a multiplicity of inter-connected lamellae expanded into a network of cells as shown schematically in FIG. 8. The expansion of the lamellae into a network of cells is analogous to the way in which paper Christmas directions can be opened up from a compressed state.

Both the panels 77 and 81 and the partition walls 85 are made of aluminium, the metal panels being approximately one millimeter thick and the partition walls being a little less than 0.1 millimeter in thickness.

As can be seen in FIG. 8, the cells are hexagonal, the hexagons being regular hexagons.

When constructing the enclosure 75, the partition walls 85 are adhesively bonded to the panels by means of an epoxy resin adhesive.

The peripheral wall 83 is also made of metal, namely, aluminium. It is in the form of a strip of metal of length corresponding to the periphery of the panels, bent to shape and bonded into place.

The panels 77 and 81 are rectangular panels and the overall depth of the enclosure is approximately 25 millimeters so that the system is a so-called "flat panel" system. The diameter of the cells (side to opposite side measurement) is approximately 25 millimeters.

If desired, sound absorbent material (not shown) can be provided within some or all of the cells of the layer of cells 87.

Figure 9:
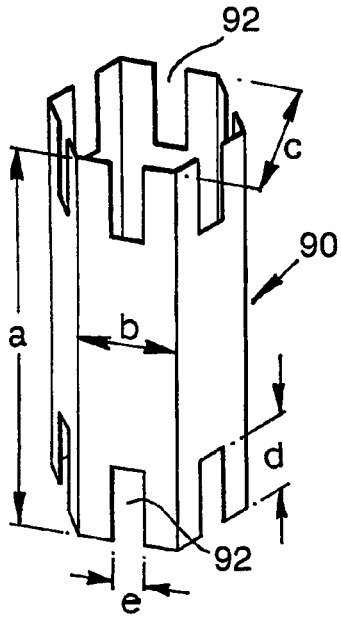
FIG. 9 is a diagrammatic illustration of a single cell identifying its dimensions.

The apertures 89 are in the form of slots at the edges of the partition walls as shown in FIG. 8. The apertures can be provided in some or all sides of the cells so as to communicate in some or all directions with adjacent cells. As seen in FIG. 9, each cell has two walls 92 parallel to each other in which the apertures 89 are provided. As seen in FIG. 8, the apertures are arranged in pairs 93A, 93B, one aperture of each pair being at the front and the other being at the rear of the metal partition walls 85. Many other arrangements of apertures are, however, possible such as apertures in the central regions of the cell walls. Holes with dimensions which change with distance from a loudspeaker drive unit according to some desired law, for example, a logarithmic law can be provided.

The overall dimensions of the enclosure 5 are 650×300×25 millimeters approximately and thus each metal panel has an overall area of approximately 1,950 square centimeters.

The construction shown has the advantage that the distance from the speaker diaphragm to the rear of the enclosure is relatively short so that standing waves in that direction within the cells are not a problem (as they can be in known speakers of which the interior is divided into cells).

Instead of making the partition walls 83 separately from the panels 7 and 11, it is possible to form them integrally with one of the panels by die-casting and then to secure the remaining panel by adhesive bonding. In that case, the partition walls are integrally bonded to one panel and adhesively bonded to the other. The partition walls are not necessarily arranged normal to the panels but may be at an angle to them. For example, a single three-dimensional sheet of material having peaks and pits in the manner of a conventional egg tray can be used to create sloping partition walls. The pits which in a conventional egg tray would hold the eggs form the cells and the spaces between the peaks form the apertures between cells. Apertures could be provided connecting one side of the single sheet to the other.

If desired, one or more reflex ports or one or more ABRs (auxiliary bass radiators) can be included in one of the panels. The ABRs may be of conventional form or as described in our specification WO 00/32010.

The peripheral wall can, if desired, be formed by the outermost part of the partition walls rather than being a separate component in its own right.

The acoustic effects of the structure depend upon the dimensioning of the cells and apertures. FIG. 9 shows a single cell 90 with especially advantageous dimensions for creating the delay effect intended when the cells of the structure conform to these dimensions. The placing of apertures 92 does not necessarily have to be uniform. The marked dimensions identified by letters are as follows:

| dimension | millimeters |
|---|---|
| a | 25 |
| b | 6 |
| c | 10 |
| d | 5 |
| e | 4 |

Figure 10:
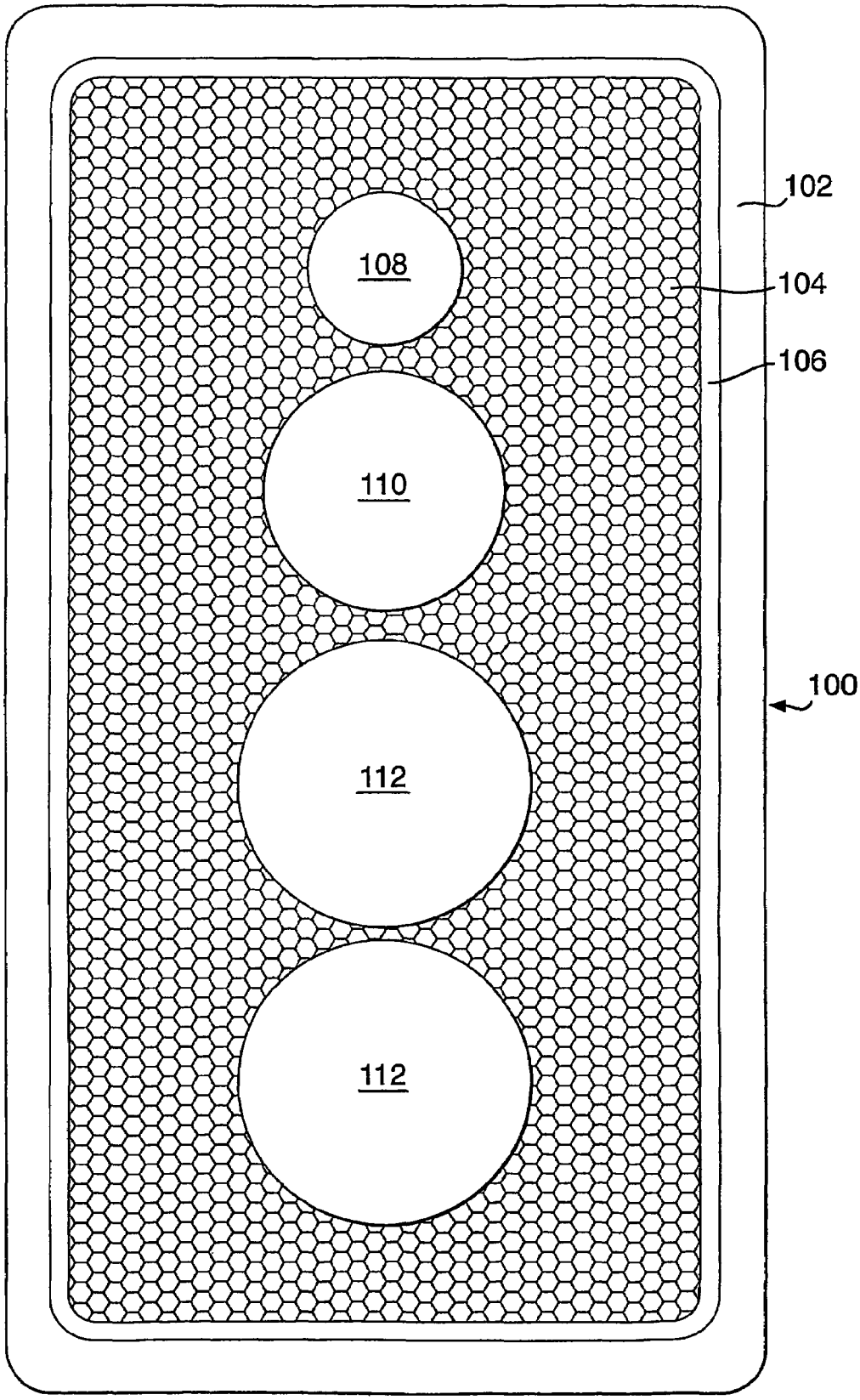
FIG. 10 is a front view of a second flat panel loudspeaker system.

FIG. 10 shows a flat panel type loudspeaker system 100 comprising two rectangular panels of transparent glass 102 (only one is visible in the drawing), a single layer of hexagonal cells 104 sandwiched between the panels and bonded to them, a peripheral wall 106 about the cells and bonded to the panels, a tweeter drive unit 108, a mid-range drive unit 110, and two bass drive units 112. The units 108 and 110 embody the invention and correspond respectively to the loudspeaker drive units of FIGS. 5 and 2. The loudspeaker system 100 in general construction corresponds to what has already been described with reference to FIGS. 7, 8 and 9 but includes more loudspeaker drive units and is of see-through construction. If desired, one or more of the loudspeaker systems could be replaced by an ABR.

Many variations on the specifically described embodiments of the invention are possible.

The type of cellular construction described in patent specification No. PCT/GB01/03249 and shown in the present FIGS. 7 to 10 can be used to define and/or fill the tubes of the multiplicity of tubes used in the present invention.

The tubes themselves can have virtually any cross section profile

The tubes can have a flat side to butt onto the rear side of the magnet assembly and the other sides may have virtually any cross-sectional profile. The cross-sectional profile can be optimized for viscous absorption losses.

The connector tube may run at virtually any angle to the loudspeaker drive unit's axis.

The multiple tubes may run at virtually any angle to the single tube.

The invention is of particular value for application to mid-range and high frequency loudspeaker drive units because the tubes can then be given dimensions such as 50 to 200 millimeters, with the number of tubes between 4 and 20, and each tube having a cross-sectional area less than 250 square millimeters. On the other hand, the application of the invention to bass units for some applications is not excluded even though substantially greater dimensions for the tubes would then be required.

The number of tubes in the multiplicity of tubes can be two, three or more tubes.

The invention claimed is:

1. A loudspeaker system comprising a loudspeaker drive unit having a front and a rear, said drive unit including a sound-producing diaphragm having front and rear faces, and a rear sound absorption system located on the rear of said loudspeaker drive unit on a sound path running rearwardly from the rear face of said diaphragm to the said rear sound absorption system, said rear sound absorption unit comprising a multiplicity of sound-absorbing tubes, operative to create acoustic loss, running in a spiral configuration.

2. A loudspeaker system as claimed in claim 1, wherein the tubes run in a spiral configuration transverse to the axis of said loudspeaker drive unit.

3. A loudspeaker system as claimed in claim 1, wherein the tubes taper away from the rear of the loudspeaker drive unit, preferably with an exponentially decreasing taper.

4. A loudspeaker system as claimed claim 1, wherein each tube has a cross-sectional area selected from the group consisting of less than 250 square millimeters, less than 200 square millimeters, less than 150 square millimeters, and less than 100 square millimeters.

5. A loudspeaker system as claimed in claim 1, wherein each tube has a length selected from the group consisting of between 50 and 200 millimeters inclusive, between 50 and 150 millimeters inclusive, between 50 and 100 millimeters inclusive, and between 60 and 80 millimeters inclusive.

6. A loudspeaker system as claimed in claim 1, wherein the number of tubes is selected from the group consisting of between 4 and 20 inclusive, between 5 and 15 inclusive, and between 6 and 12 inclusive.

7. A loudspeaker system comprising a loudspeaker drive unit having a front and a rear, and a rear sound absorption system having a first end located on the rear of said loudspeaker drive unit, said first end of said rear sound absorption system defining an entry for sound which comes back from the rear of said drive unit, and said rear sound absorption unit comprising a multiplicity of sound-absorbing tubes running spirally about the axis of the loudspeaker drive unit, said sound-absorbing tubes having a sound absorption mechanism selected from the group consisting of sound-absorbing material located in said tubes, viscous losses created by the narrowness of said tubes, and a sound-absorbing cellular structure located in said tubes.

8. A loudspeaker system as claimed in claim 7, wherein said tubes taper away from the rear of the loudspeaker drive unit.

9. A loudspeaker drive unit as claimed in claim 7, wherein the tubes are defined by first and second juxtaposed components.

10. A loudspeaker drive unit as claimed in claim 9, wherein the tubes are defined by a multiplicity of channels located on the first component, the open faces of the channels being closed by a face of the second component to define the tubes.

11. A loudspeaker system as claimed in claim 7, wherein the channels are defined by upstanding walls on the first component.

12. A loudspeaker system as claimed in claim 10, wherein the depth of each channel is selected from the group consisting of between 3 and 10 millimeters inclusive, and between 4 and 7 millimeters inclusive.

13. A loudspeaker system comprising a loudspeaker drive unit having a front and a rear, and a rear sound absorption system having front and rear ends, the front end of said rear sound absorption system being located on the rear of said loudspeaker drive unit, said front end of said rear sound absorption unit defining an inlet for sound arriving from the rear of said loudspeaker drive unit, and said rear sound absorption unit comprising a multiplicity of sound-absorbing tubes defined by first and second juxtaposed components, sound-absorbing material being located between said first and second juxtaposed components, said tubes running in a spiral configuration.

14. A loudspeaker drive unit as claimed in claim 13, wherein the tubes run in a spiral configuration transverse to the axis of said loudspeaker drive unit.

15. A loudspeaker drive unit as claimed in claim 13, wherein the tubes are defined by a multiplicity of channels located on the first component, the open faces of the channels being closed by a face of the second component to define the tubes.

16. A loudspeaker system as claimed in claim 13, wherein the rear sound absorption system includes a common connecting tube, preferably running substantially co-axially with the axis of the loudspeaker drive unit, which connects the rear of the loudspeaker drive unit to the multiplicity of tubes.

17. A loudspeaker drive unit as claimed in claim 16, wherein the tubes of the said multiplicity are connected to different points along the length of the connecting tube.

18. A loudspeaker system as claimed in claim 13, wherein the number of tubes is selected from the group consisting of between 4 and 20 inclusive, between 5 and 15 inclusive, and between 6 and 12 inclusive.

19. A loudspeaker system as claimed in claim 13, wherein the tubes are so arranged that high pressure points of the standing waves in one tube are adjacent to low pressure points in an adjacent tube and communication is provided between adjacent tubes along their lengths.

20. A loudspeaker system as claimed in claim 1, wherein said tubes contain sound-absorbing material.

21. A loudspeaker system as claimed in claim 1, wherein said tubes have a narrowness such as to provide an acoustic loss mechanism due to viscous losses in the air within the tubes.

22. A loudspeaker system as claimed in claim 1, wherein said tubes contain a sound-absorbing cellular structure.

23. A loudspeaker system as claimed in claim 7, wherein said tubes taper away from the rear of the loudspeaker drive unit with an exponentially decreasing taper.

24. A loudspeaker system as claimed in claim 13, wherein the tubes are so arranged that high pressure points of the standing waves in one tube are adjacent to low pressure points in an adjacent tube and communication is provided between adjacent tubes along their lengths at a multiplicity of points along the entire length of the tubes.

* * * * *